US007440251B2

(12) United States Patent
Opfer

(10) Patent No.: US 7,440,251 B2
(45) Date of Patent: Oct. 21, 2008

(54) MULTI-PATH SWITCHING CONFIGURATION

(75) Inventor: John C. Opfer, Chicago, IL (US)

(73) Assignee: S & C Electric Co., Chicago, IL (US)

( * ) Notice: Subject to any disclaimer, the term of this patent is extended or adjusted under 35 U.S.C. 154(b) by 53 days.

(21) Appl. No.: 11/299,268

(22) Filed: Dec. 12, 2005

(65) Prior Publication Data

US 2006/0196851 A1 Sep. 7, 2006

Related U.S. Application Data

(60) Provisional application No. 60/637,087, filed on Dec. 20, 2004.

(51) Int. Cl.
*H01H 73/00* (2006.01)

(52) U.S. Cl. ..... 361/115

(58) Field of Classification Search ..... 361/115
See application file for complete search history.

(56) References Cited

U.S. PATENT DOCUMENTS 6,127,637 A * 10/2000 Estey et al. ..... 200/48 P

* cited by examiner

*Primary Examiner*—Michael J Sherry
*Assistant Examiner*—Lucy Thomas
(74) *Attorney, Agent, or Firm*—James V. Lapacek

(57) ABSTRACT

A multi-path switching configuration provides independent switching of multiple circuit paths. In a preferred arrangement, a plurality of circuit interrupters have one end connected in common with each other and a second end providing a circuit path connection. An operating facility is arranged to independently operate the circuit interrupters via an operating member operatively connected to a respective circuit interrupter and controlling the respective interrupting path. Two or more of the operating members are moved to selectively provide desired connections of circuit paths.

2 Claims, 3 Drawing Sheets

MULTI-PATH SWITCHING CONFIGURATION

This application claims the benefit of U.S. Provisional Application No. 60/637,087 filed on Dec. 20, 2004.

BACKGROUND OF THE INVENTION

1. Field of the Invention

The present invention relates generally to the field of switching and circuit interruption and more particularly to a multi-path switching configuration for providing independent switching of multiple circuit paths.

2. Description of the Related Art

In order to provide independent switching of multiple transmission lines that are joined together, switching configurations have been utilized including a common interrupter and multiple disconnect blades, i.e. one disconnect blade for each line.

While the arrangements of the prior art may be generally suitable for their intended uses, it would be desirable to provide an improved multi-path switching configuration for providing independent switching of multiple circuit paths.

SUMMARY OF THE INVENTION

Accordingly, it is a principal object of the present invention to provide a multi-path switching configuration for providing independent switching of multiple circuit paths.

These and other objects of the present invention are efficiently achieved by a multi-path switching configuration for providing independent switching of multiple circuit paths. In a preferred arrangement, a plurality of circuit interrupters have one end connected in common with each other and a second end providing a circuit path connection. An operating facility is arranged to independently operate the circuit interrupters via an operating member operatively connected to a respective circuit interrupter and controlling the respective interrupting path. Two or more of the operating members are moved to selectively provide desired connections of circuit paths.

BRIEF DESCRIPTION OF THE DRAWING

The invention, both as to its organization and method of operation, together with further objects and advantages thereof, will best be understood by reference to the specification taken in conjunction with the accompanying drawing in which:

FIG. 1 is a perspective view of present invention to provide multi-path switching configuration for providing independent switching of multiple circuit paths;

DETAILED DESCRIPTION

Figure 7:
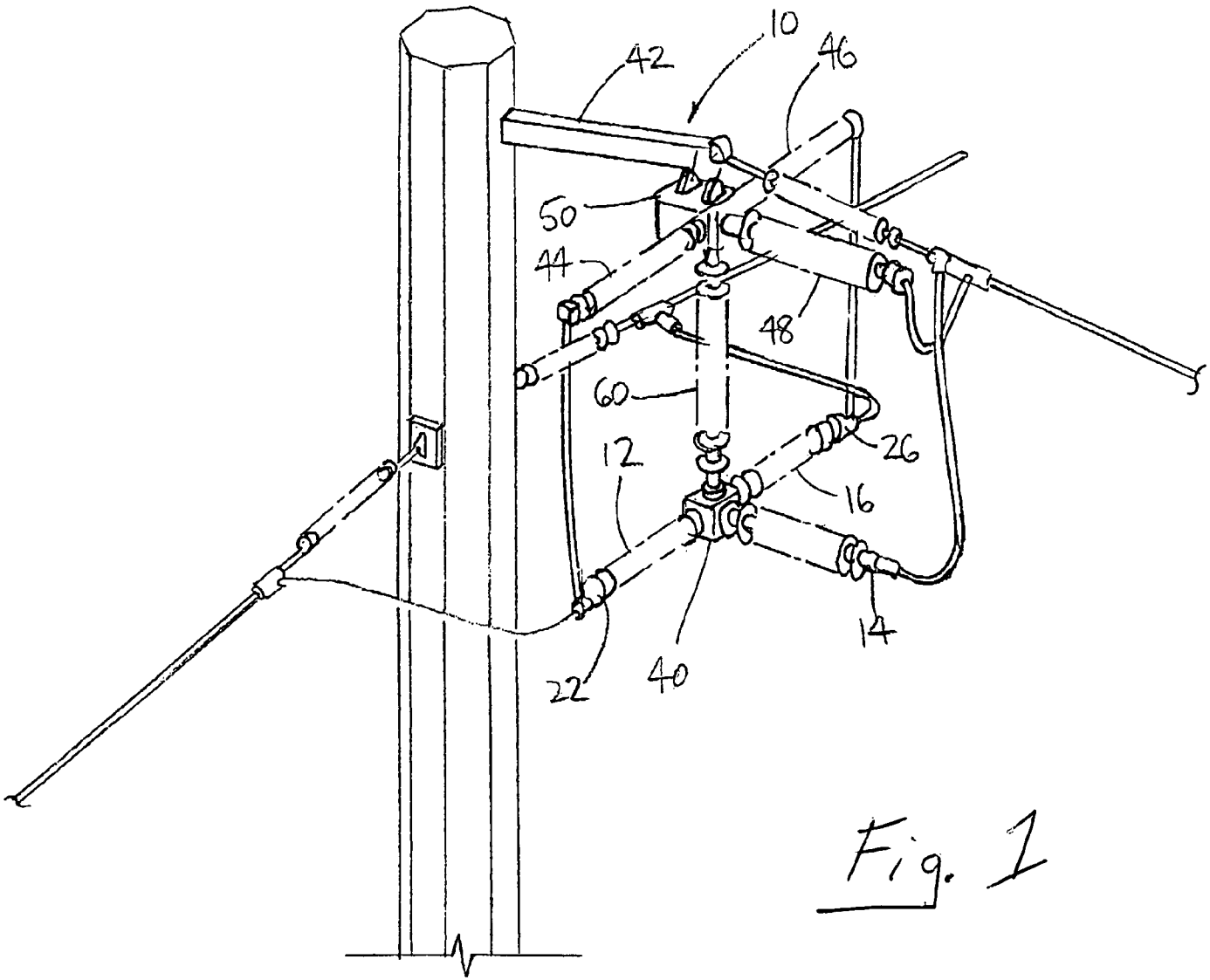
Figure 2:
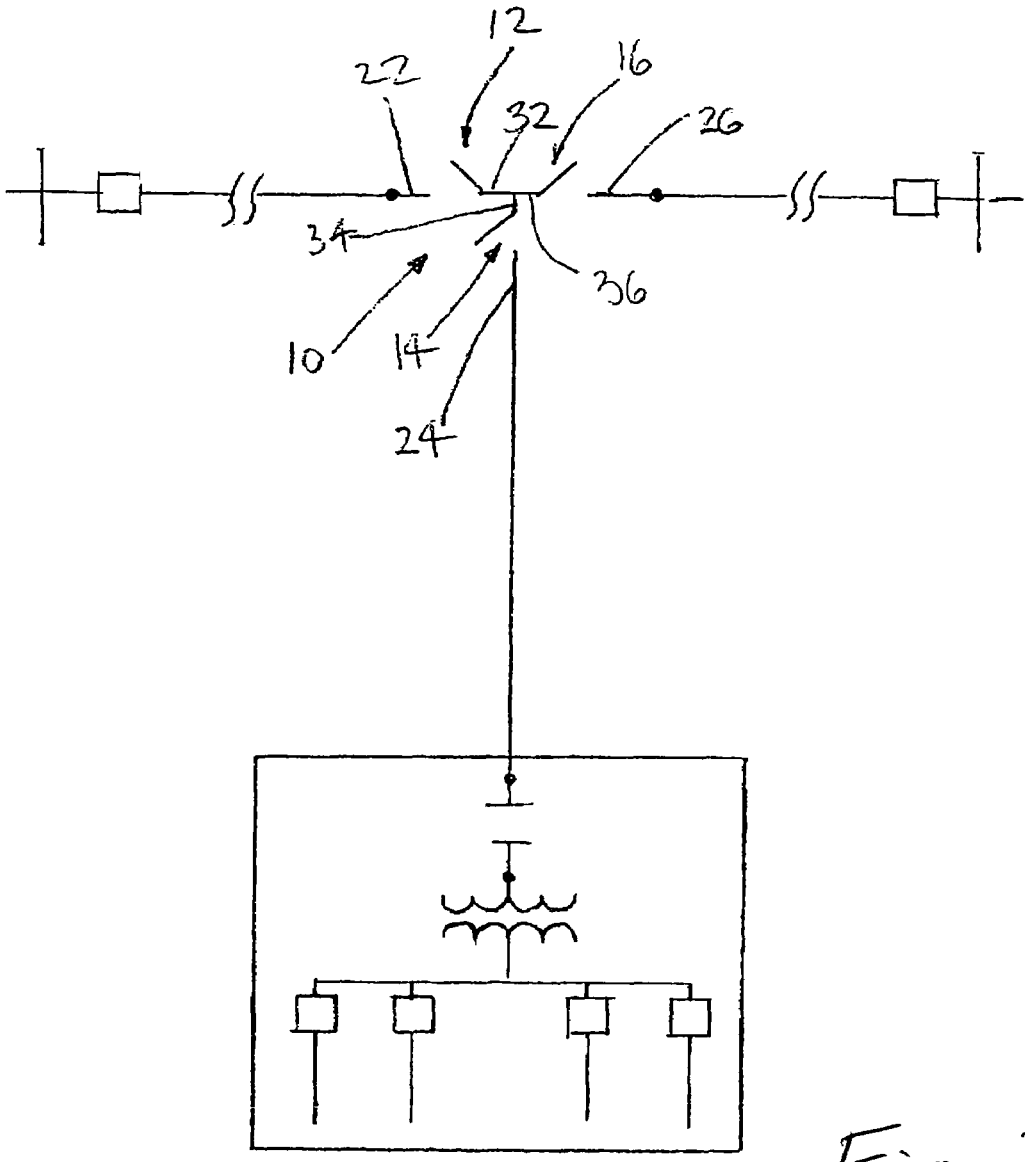
FIG. 2 is a diagrammatic view of the of multi-path switching configuration of FIG. 1.
Figure 3:
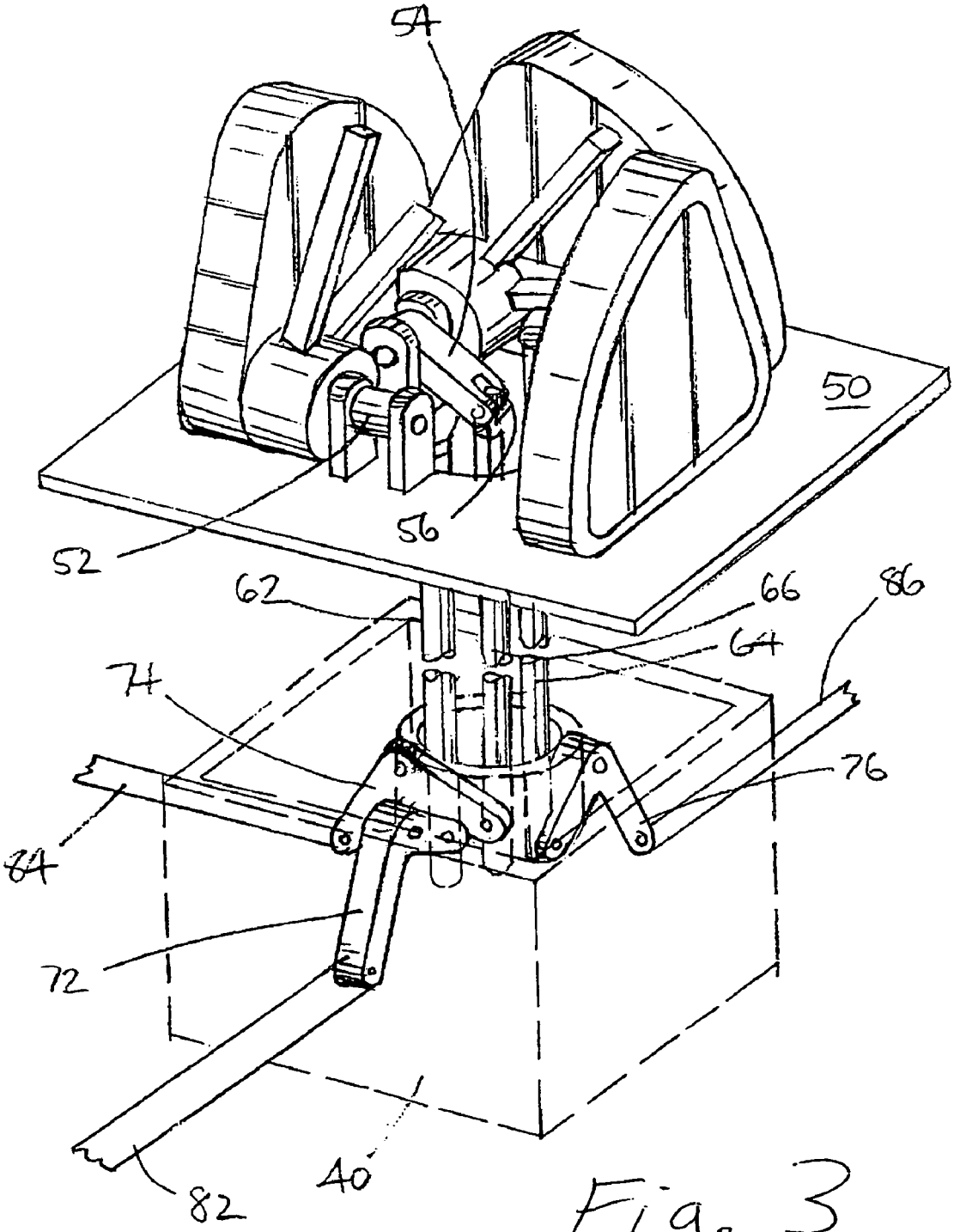
FIG. 3 is a perspective view, with parts removed for clarity, of the switching configuration of FIG. 1 illustrating more details of a common mechanism and operating linkages.

Referring now to FIGS. 1 and 2, an illustrative multi-path switching configuration 10 in accordance with the present invention as shown in FIG. 1 includes three interrupters 12, 14, 16 each having one respective end or circuit path connection 22, 24, 26 connected to a respective circuit path or line and a second respective end or circuit path connection 32, 34, 36 (FIG. 2) connected in common at a transition housing 40 (FIG. 1). The connections 32, 34 and 36 of the interrupters 12, 14 16 and the transition housing 40 are supported by and insulated from ground connections via an insulating support column 60. The insulating support column 60 is connected to a common mechanism 50 at electrical ground potential. As shown in FIG. 3, the common mechanism 50 includes outputs at 52, 54 and 56, illustrated as operating cranks, that are connected to respectively operate insulated operating members 62, 64 and 66 that extend through the insulating support column 60 to operate the interrupters 12, 14, 16, e.g. as illustrated, via respective operating cranks 72, 74, 76 located within the transition housing 40 connected to respective operating rods 82, 84 86 of the interrupters 12, 14, 16.

As illustrated in FIG. 1, the 3-pole multi-path switching configuration 10 is suspended from a support arm 42 via the mechanism 50. As shown, this mounting arrangement permits the configuration 10 to move in a plane perpendicular to the support arm 42 to minimize loads due to movement of the conductors at 22 and 26. Potential devices 44, 46 48 are included in various configurations where voltage sensing and/or control power is desired for one or more of the paths.

Thus, as set forth, the present invention provides a multi-path switching configuration 10 with independent switching of the multiple circuit paths connected at 22, 24 26, e.g. via operating two or more of the interrupters 12, 14, 16 to provide desired interconnection of three circuit paths.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

The invention claimed is:

1. A multi-path switching configuration comprising:

a plurality of circuit interrupters each having an interrupting path, a first circuit path end for respective connection to respective electrical circuits and a second circuit path end each of which is connected in common with each other, and operating means for independently and selectively operating each of said circuit interrupters and including a respective operating member operatively connected to a respective circuit interrupter and means for controlling the position of said operating members for controlling the respective interrupting paths, such that said operating means selectively operates two or more of said plurality of circuit interrupters to selectively provide desired connections of the electrical circuits connected to the first circuit paths end, said operating means comprising an insulating support column for housing said operating members and a transition housing that supports said interrupters at said respective second circuit path ends and is connected to said insulating support column and receives said operating member therein.

2. The multi-path switching configuration of claim 1 wherein said operating means further comprises a mechanism having a drive output connection for each of said operating members.

* * * * *